United States Patent [19]

Takahashi et al.

[11] 4,079,204

[45] Mar. 14, 1978

[54] AM STEREOPHONIC TRANSMISSION SYSTEM

[75] Inventors: Susumu Takahashi; Hirotaka Kurata, both of Tokyo, Japan

[73] Assignee: Sansui Electric Co., Ltd., Japan

[21] Appl. No.: 753,298

[22] Filed: Dec. 22, 1976

[30] Foreign Application Priority Data

Dec. 26, 1975 Japan ..... 51-158608
Dec. 26, 1975 Japan ..... 51-158609

[51] Int. Cl.[2] ..... H04H 5/00
[52] U.S. Cl. ..... 179/15 BT; 325/36
[58] Field of Search ..... 179/15 BT; 325/36, 47; 343/200, 205, 207

[56] References Cited

U.S. PATENT DOCUMENTS

| | | | |
|---|---|---|---|
| 3,069,679 | 12/1962 | Sweeney et al. | 179/15 BT |
| 3,087,995 | 4/1963 | Hellstrom | 179/15 BT |
| 3,143,600 | 8/1964 | De Vries | 179/15 BT |
| 3,218,393 | 11/1965 | Kahn | 179/15 BT |
| 3,908,090 | 9/1975 | Kahn | 179/15 BT |
| 4,018,994 | 4/1977 | Kahn | 179/15 BT |

*Primary Examiner*—Douglas W. Olms
*Attorney, Agent, or Firm*—Harris, Kern, Wallen & Tinsley

[57] ABSTRACT

An AM stereophonic transmission system in which a carrier wave signal is phase- or frequency-modulated by an audio composite signal L − *j*R or L + *j*R and the phase- or frequency-modulated carrier wave signal is further amplitude-modulated by an audio composite signal L + *j*R or L − *j*R.

4 Claims, 7 Drawing Figures

FIG. 1A PRIOR ART
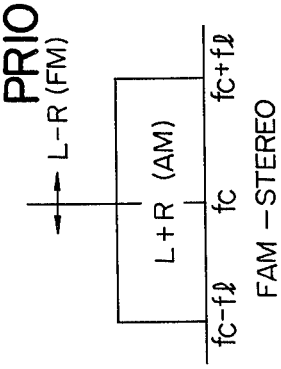
FIG. 1B PRIOR ART
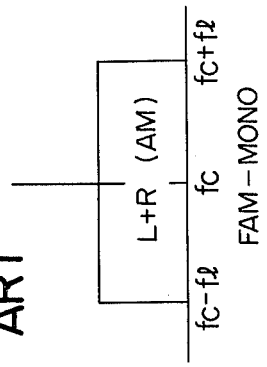
FIG. 2A PRIOR ART
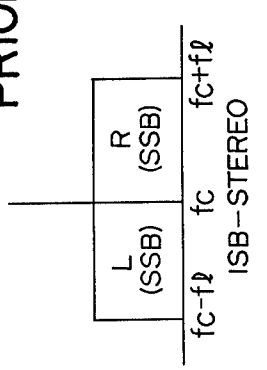
FIG. 2B
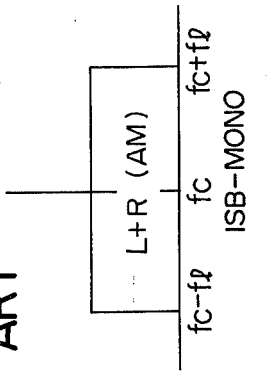
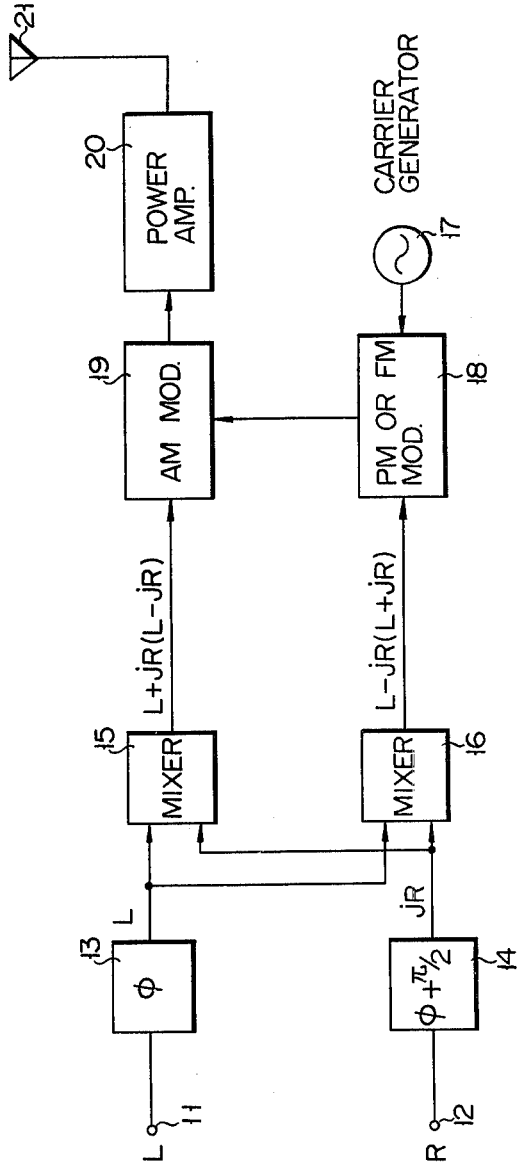
FIG. 3

AM STEREOPHONIC TRANSMISSION SYSTEM

The present invention relates to an AM stereophonic transmission system compatible with existing AM monophonic receivers.

Diverse AM stereophonic transmission systems have been proposed. Two types of such transmission systems will be referred to here. The first is the FAM stereophonic transmission system described in "A Compatible Stereophonic System for AM Stereo Band" by J. AVINS, L. A. FREEDMAN et al, in RCA REVIEW, Aug. 1, 1960. In this system, a carrier wave signal is amplitude-modulated by the sum of stereophonically related audio signals L and R, and is frequency-modulated by the difference of the audio signals L and R. The frequency spectrums in the stereophonic and monophonic broadcasts in this system are shown in FIGS. 1A and 1B respectively. In the figure, the carrier frequency is designated by $fc$ and the maximum frequency of the audio signal by $F_l$. The conventional monophonic receiver can reproduce the sum L + R of audio signals from the received amplitude-modulated signal so that the FAM stereophonic broadcast is compatible with the conventional AM receiver.

The second is the AM stereophonic transmission system called the ISB (Independent Sideband) system or the SSB - SSB system described in "A stereophonic System for Amplitude-Modulated Broadcast Stations" by Leonard R. Kahn in IEEE Transactions on Broadcasting, June, 1971.

In this system, a first carrier is amplitude-modulated by the sum of the audio signals L and R, and a second carrier in phase quadrature with the first carrier is double-sideband supressed-carrier amplitude-modulated by the difference $j(L-R)$ between the audio signals which is phase-shifted by 90° relative to the sum of the audio signals. Then, the L + R modulated carrier and the double-sideband suppressed-carrier amplitude-modulated j(L − R) signal are added together so that the left audio signal L is transmitted by the lower sideband of AM wave while the right audio signal R by the upper sideband of the AM wave. The frequency spectrums in the stereophonic and the monophonic broadcasts in this transmission system are shown in FIGS. 2A and 2B, respectively. The ISB stereophonic transmission system is also compatible with the conventional monophonic receiver, although the reproduction of L + R signal by the conventional receiver is accompanied by a small amount of distortion.

The conventional monophonic receiver insufficiently reproduce an opposite-phase signal included in the audio signals L and R, in either system of FAM or ISB. Particularly, when the opposite-phase signal is distributed to left and right channels at an equal amplitude levels, it is impossible to reproduce such signal. In a matrix four-channel stereophonic system, a rear signal is distributed in an opposite-phase relationship to the stereophonic channels. When the stereophonic signals from a stereo disc recorded by such a system is broadcasted, the monophonic receiver reproduces insufficiently the rear signal.

In the present day stereo recording techniques, a phantom channel signal is distribited in the sine-cosine relation to the left and right channels, respectively. Particularly, the center channel signal is distributed to the respective left and right channels with the amplitude level of 0.707 (= sin 45° = cos 45°). Accordingly, when the stereophonic broadcasts in accordance with the above-mentioned AM stereophonic systems are received by the AM monophonic receiver, the level-up of the phantom channel signal is inevitable relative to the right and left channel signals. Since the monophonic receiver reproduces the sum L + R of audio signals, the level of the center channel signal is raised by 3 db relative to the left or right signal by reason that 0.707L + 0.707R = 1.414L (L = R).

Accordingly, an object of the present invention is to provide an AM stereophonic transmission system which is fully compatible with a existing AM monophonic receiver.

Another object of the present invention is to provide AM stereophonic transmission system permitting an exisiting AM monophonic receiver to fully reproduce an opposite-phase signal component included in the stereophonic signals.

Still another object of the present invention is to provide an AM stereophonic transmission system enabling an AM monophonic receiver to reproduce phantom channel signals without any level change.

A still further other object of the present invention is to provide an AM stereophonic transmission system permitting an AM monophonic receiver with a relatively simple construction to reproduce the stereophonic signals.

According to one aspect of the present invention, there is provided an AM stereophonic transmission system for transmitting stereophonically related first and second audio information signals to at least one receiver, comprising means for phase-shifting said first and second audio information signals to introduce a relative phase shift of substantially 90° therebetween; means for forming a first audio composite signal by composing said phase-shifted first and second audio information signals; means for forming a second audio composite signal by composing said phase-shifted first and second audio information signals; means for frequency-or phase-modulating a carrier signal by said first audio composite signal; and means for amplitude-modulating said frequency- or phase-modulated carrier signal by said second audio composite signal.

According to another aspect of the present invention, there is provided an AM stereophonic reception system for reproducing stereophonically related first and second audio information signals from a modulated wave being formed in a manner that a carrier wave signal is phase- or frequency-modulated by a first audio composite signal including the first and second audio information signals between which a relative phase shift of substantially 90° is introduced and the modulated carrier wave signal is further amplitude-modulated by a second composite signal including the first and second audio information signals between which the relative phase shift of substantially 90° is introduced, one of said first and second audio composite signals being the sum of said phase shifted first and second audio information signals and the other thereof being the difference therebetween, said reception system comprising: means for amplitude-demodulating said modulated wave to recover said second audio composite signal from said modulated wave; means for phase- or frequency-demodulating said modulated wave to recover said first audio composite signal from said modulated wave; and means for composing said recovered first and second audio composite signals to reproduce said first and second audio information signals having the relative phase shift of substantially 90 degrees therebetween.

Other objects and features of the present invention will be apparent from the following description taken in connection with the accompanying drawings, in which:

FIGS. 1A and 1B show frequency spectrums of a stereophonic and monophonic broadcasts by a prior art AM stereophonic transmission system, respectively;

FIGS. 2A and 2B show frequency spectrums of a stereophonic broadcast and a monophonic broadcast by another prior art AM stereophonic transmission system;

FIG. 3 shows a block diagram of an AM stereophonic transmission system of an embodiment of the present invention;

Figure 4:
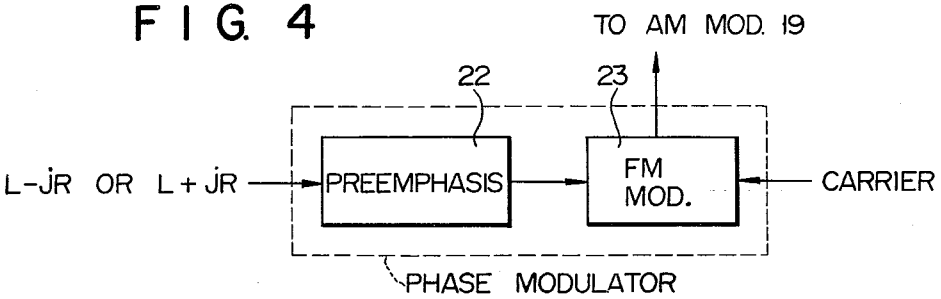
FIG. 4 shows an example of a phase modulator which may be used in the transmission system of FIG. 3.

Reference is now made to FIG. 3 showing a schematic block diagram of an AM stereophonic broadcast transmitter according to the present invention. In the figure, reference numerals 11 and 12 designate terminals for receiving stereophonically related left and right audio signals L and R from a stereo audio source. The terminals 11 and 12 are connected to a $\phi$ phase shifter 13 and a $\phi + (\pi/2)$ phase shifter 14 respectively, to introduce a relative phase shift of 90° between the left and right audio signals L and R. The phase-shifted left and right audio signals L and $j$R are supplied to mixers 15 and 16 where first and second audio composite signals are produced. When the mixers 15 and 16 are an adder and a subtractor, respectively, the first audio composite signal is expressed by L + $j$R and the second audio composite signal is by L − $j$R. To the contrary, when the mixers 15 and 16 are a subtractor and an adder, respectively, the first audio composite signal is by L − $j$R and the second audio composite signal is by L + $j$R. A high frequency carrier generated from a high frequency carrier generator 17 is fed to a phase or frequency modulator 18 where it is phase- or frequency-modulated by the second audio composite signal. The modulated carrier from the phase or frequency modulator 18 is fed to an amplitude modulator 19 where it is amplitude-modulated by the first audio composite signal. The output of the amplitude modulator 19 is fed to a transmitting antenna 21 through a power amplifier 20, if desired.

Assume now that the left audio signal L is expressed by $l \sin \Omega lt$, the right audio signal R by $r \sin \Omega rt$, the carrier by V $\sin \omega t$, the first audio composite signal by L + $j$R, and a phase modulator is used for the modulator 18. The modulated wave $v$ from the modulator 19 may be expressed as follows:

$$v = V(1 + l \sin \Omega lt + r \cos \Omega rt) \times \sin (\omega t + \Delta\theta_1 \sin \Omega lt - \Delta\theta_2 \cos \Omega rt)$$

where $\Delta\theta_1$ is a displacement of the phase angle of the carrier depending on the signal L, and $\Delta\theta_2$ is a displacement of the phase angle of the carrier depending on the signal R.

The phase modulator may be constructed by a 6 db/oct preemphasis circuit 22 and a frequency modulator 23, as shown in FIG. 4.

It will be understood that, when the broadcast signal transmitted from the above-mentioned transmitter is received by a conventional AM monophonic receiver, the envelope detector can reproduce the amplitude modulation component L + $j$R or L − $j$R without any distortion. When the front center signal (L = R = 0.707) is transmitted by the above-mentioned AM stereophonic transmission system, L + $j$R = 0.707 + $j$0.707 = $1\angle +45°$ or L − $j$R = 0.707 − $j$0.707 = $1\angle -45°$, and thus the level of the front center signal is not increased in the AM receiver. In other words, when using the AM stereophonic transmission system of the present invention, the phantom channel signal is not leveled up in the AM receiver. Even if the opposite-phase signal is included in the sterephonic signals L and R, the reproduction signal of the AM receiver is L + $j$R or L − $j$R so that the opposite-phase signal can be reproduced completely by the AM receiver.

Figure 5:
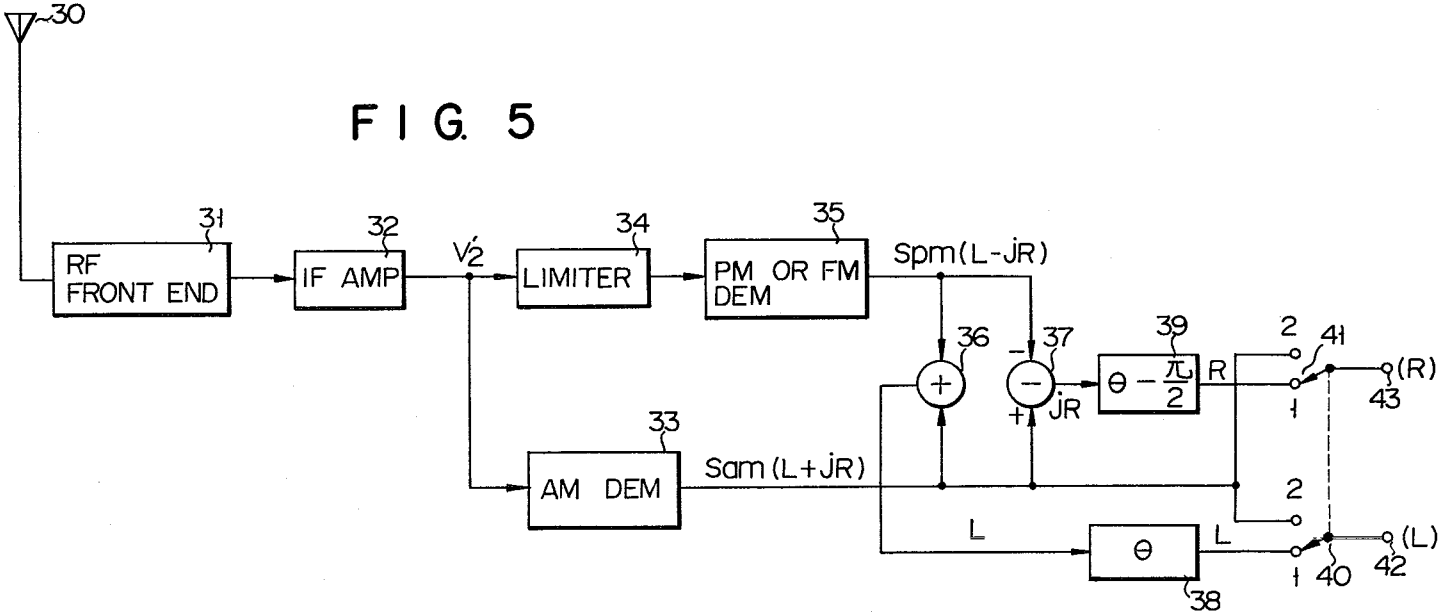
FIG. 5 shows a block diagram of an embodiment of an AM stereophonic receiver according to the present invention.

The description to follow is an AM stereophonic receiver according to the present invention. In FIG. 5, reference numberal 30 designates an antenna for receiving the broadcast signal. The broadcast signal received by the antenna is shifted to an intermediate frequency band by a known tunable front-end 31 including a RF amplifier and a frequency converter. The intermediate frequency signal from the front-end 31 is amplified by an intermediate frequency amplifier 32. In the transmitter of FIG. 3, if the amplitude modulation component is L + $j$R and the phase or frequency modulation component is L − $j$R, the intermediate frequency signal $V_1$ is given by:

$$v_1 = V(1 + l \sin \Omega lt + r \cos \Omega rt) \times \sin (\omega ot + \Delta\theta_1 \sin \Omega lt - \Delta\theta_2 \cos \Omega rt)$$

where $\omega o$ is an angular frequency of the intermediate frequency carrier.

The intermediate frequency signal $v_1$ is coupled with an AM demodulator 33 to produce a signal S$am$ proportional to $l \sin \Omega lt + r \cos \Omega rt$ which represents L + $j$R. With designation of $k_1$ for a proportional constant, the S$am$ is expressed as follows:

$$Sam = k_1 (l \sin \Omega lt + r \cos \Omega rt)$$

The output signal $v_1$ of the intermediate frequency amplifier 32 also is fed to an amplitude limiter 34 to remove the amplitude variation component of the intermediate frequency signal $v_1$. Accordingly, the output signal of the limiter 34 includes only the phase or frequency modulation component. The output signal of the limiter 34 is applied to a PM or FM demodulator 35 which in turn produces an output signal S$pm$ representing L − $j$R. When the phase modulation is used in the transmitter, since the phase angle displacements $\Delta\theta_1$ and $\Delta\theta_2$ are proportional to $l$ or $r$, the output signal S$pm$ of the demodulator 35 is expressed by the equation $$Spm = k_2(l \sin \Omega lt - r \cos \Omega rt),$$

where $k_2$ is a proportional constant.

The output signal S$am$ of the AM demodulator 33 and the output signal S$pm$ of the PM demodulator 35 are delivered to an adder 36 and a subtractor 37. If the proportional constants $k_1$ and $k_2$ are adjusted such that $k_1 = k_2 = k$, the output signal S$l$ of the adder 36 and the output signal S$r$ of the subtractor 37, respectively, are given by:

$$Sl = 2kl \sin \Omega lt$$

$$Sr = 2kr \cos \Omega rt$$

Note that $Sl$ and $Sr$ represent the audio signals L and $+jR$, respectively.

The output signal $Sl$ of the adder 36 and that $Sr$ of the subtractor 37 are delivered to a $\theta$ phase shifter 38 and a $\theta - (\pi/2)$ phase shifter 39. The outputs of the phase shifters 38 and 39 provide the audio signals L and R, respectively. The output signals of the phase shifters 38 and 39 are coupled to output terminals 42 and 43, through stereophonic-monophonic reception mode changing switches 40 and 41 which are in the stereophonic reception mode position as shown. In the AM monophonic reception mode, the output of the AM demodulator 33 is coupled with the output terminals 42 and 43, through the switches 40 and 41.

According to the AM stereophonic transmission system of the present invention, the generation of a synchronous carrier in the receiver is not necessarily required so that the construction of the AM stereophonic receiver is simplified.

In the receiver of FIG. 5, the broadcast signal received by the antenna is converted into an intermediate frequency signal, however, the broadcast signal may be demodulated without frequency conversion process.

In the FIG. 5 receiver, the phase shifters 38 and 39 are used to remove the relative phase shift of 90° provided between the audio signals in the transmitter, thereby returning the signals to the original phase conditions. It is noted, however, that the phase shifters are not essential in the receiver. In case where the phase shifters are provided in the receiver, the phase shifters in the receiver are not necessarily required to have the phase-shifting characteristics equal to those of phase shifters in the transmitter, and thus the former phase shifters may be more simple in construction than the later ones.

What we claim is:

1. An AM stereophonic transmission system for transmitting stereophonically related first and second audio information signals to at least one receiver, comprising:

means for phase-shifting said first and second audio information signals to introduce a relative phase shift of substantially 90° therebetween:

means for forming a first audio composite signal by composing said phase-shifted first and second audio information signals;

means for forming a second audio composite signal by composing said phase-shifted first and second audio information signals;

means for frequency- or phase-modulating a carrier signal by said first audio composite signal; and means for amplitude-modulating said frequency- or phase-modulated carrier signal by said second audio composite signal.

2. A system according to claim 1, in which said first audio composite signal is the sum of said phase-shifted first and second audio information signals and said second audio composite signal is the difference therebetween.

3. A system according to claim 1, in which said first audio composite signal is the difference between said phase-shifted first and second audio information signals and said second audio composite signal is the sum of them.

4. An AM stereophonic reception system for reproducing stereophonically related first and second audio information signals from a modulated wave being formed in a manner that a carrier wave signal is phase- or frequency-modulated by a first audio composite signal including the first and second audio information signals between which a relative phase shift of substantially 90° is introduced and the modulated carrier wave signal is further amplitude-modulated by a second composite signal including the first and second audio information signals between which the relative phase shift of substantially 90° is introduced, one of said first and second audio composite signals being the sum of said phase shifted first and second audio information signals and the other thereof being the difference therebetween, said reception system comprising:

means for amplitude demodulating said modulated wave to recover said second audio composite signal from said modulated wave;

means for phase or frequency demodulating said modulated wave to recover said first audio composite signal from said modulated wave;

means for composing said recovered first and second audio composite signals to reproduce said first and second audio information signals having the relative phase shift of substantially 90° therebetween; and means for phase-shifting said first and second audio information signals reproduced to reduce the amount of the relative phase-shift between said first and second audio information signals.

* * * * *